US009802231B2

(12) United States Patent
Fuchs et al.

(10) Patent No.: US 9,802,231 B2
(45) Date of Patent: Oct. 31, 2017

(54) BENDING AND BALANCING DEVICE FOR AXIALLY SHIFTABLE WORK ROLLS OF A ROLLING MILL

(75) Inventors: Wolfgang Fuchs, Hilchenbach (DE); Dietmar Rohleder, Hilchenbach (DE)

(73) Assignee: SMS GROUP GMBH, Düsseldorf (DE)

( * ) Notice: Subject to any disclaimer, the term of this patent is extended or adjusted under 35 U.S.C. 154(b) by 1391 days.

(21) Appl. No.: 13/146,072

(22) PCT Filed: Jan. 22, 2010

(86) PCT No.: PCT/EP2010/000384
§ 371 (c)(1),
(2), (4) Date: Jul. 25, 2011

(87) PCT Pub. No.: WO2010/084011
PCT Pub. Date: Jul. 29, 2010

(65) Prior Publication Data

US 2011/0283763 A1 Nov. 24, 2011

(30) Foreign Application Priority Data

Jan. 23, 2009 (DE) ..... 10 2009 005 964
Dec. 18, 2009 (DE) ..... 10 2009 058 876

(51) Int. Cl.
*B21B 29/00* (2006.01)
*B21B 31/20* (2006.01)
(Continued)

(52) U.S. Cl.
CPC ..... *B21B 29/00* (2013.01); *B21B 31/203* (2013.01); *B21B 31/18* (2013.01);
(Continued)

(58) Field of Classification Search
CPC ..... B21B 29/00; B21B 31/203
(Continued)

(56) References Cited

U.S. PATENT DOCUMENTS 4,543,810 A * 10/1985 Stoy et al. ..... 72/241.8
4,907,439 A 3/1990 Diel et al.
(Continued)

FOREIGN PATENT DOCUMENTS

CN 1350480 5/2002
DE 3843387 A1 7/1990
(Continued)

*Primary Examiner* — Shelley Self
*Assistant Examiner* — Mohammad Yusuf
(74) *Attorney, Agent, or Firm* — Lucas & Mercanti, LLP; Klaus P. Stoffel

(57) ABSTRACT

The invention relates to a bending and balancing device for axially shiftable work rolls (10, 10') of a rolling mill, especially of a four-high rolling mill, guide blocks (2) being provided at both sides in the window of every mill housing (1) on the level of the work roll inserts (3, 3') and the force of bending and balancing cylinders (5) being transmissible onto the work roll inserts that are guided in the axial direction and so as to be shiftable in the vertical direction. The guide blocks are subdivided into respective upper and lower guide blocks (2, 2'), the upper guide blocks (2) are mounted in the mill housing window so as to be vertically shiftable, the lower guide blocks (2') are mounted in the mill housing window so as to be fixed or so as to be vertically shiftable, and a bending and balancing cylinder (5) is arranged in every of the associated upper and lower guide blocks and is guided by the same and engages with the upper and the lower work roll insert.

6 Claims, 4 Drawing Sheets

(51) Int. Cl.
*B21B 31/18* (2006.01)
*B21B 13/02* (2006.01)

(52) U.S. Cl.
CPC ..... *B21B 2013/025* (2013.01); *B21B 2269/04* (2013.01); *B21B 2269/14* (2013.01)

(58) Field of Classification Search
USPC ..... 72/241.2–241.8, 245–246
See application file for complete search history.

(56) References Cited

U.S. PATENT DOCUMENTS

| | | | | |
|---|---|---|---|---|
| 4,934,166 | A * | 6/1990 | Giacomoni | 72/245 |
| 4,967,582 | A | 11/1990 | Bohnenkamp | |
| 5,090,228 | A * | 2/1992 | Schmiedberg et al. | 72/245 |
| 5,195,346 | A * | 3/1993 | Braun et al. | 72/245 |
| 6,112,569 | A * | 9/2000 | Ossendorf | 72/241.8 |
| 6,164,111 | A | 12/2000 | Langeder | |
| 6,993,951 | B1 * | 2/2006 | Sudau et al. | 72/241.8 |
| 7,895,871 | B2 * | 3/2011 | Zieser et al. | 72/245 |
| 8,132,440 | B2 * | 3/2012 | Cooper | 72/245 |
| 8,196,444 | B2 * | 6/2012 | Hohenbichler et al. | 72/241.8 |
| 2011/0132055 | A1 * | 6/2011 | Diehl et al. | 72/245 |

FOREIGN PATENT DOCUMENTS

| | | | |
|---|---|---|---|
| DE | 19938217 | A | 4/2000 |
| DE | 19938217 | A1 | 4/2000 |
| DE | 19922373 | A1 | 11/2000 |
| DE | 10334682 | A2 | 2/2005 |
| EP | 0256408 | A | 2/1988 |
| EP | 0256408 | A2 | 2/1988 |
| EP | 0256410 | A2 | 2/1988 |
| EP | 0340504 | A | 11/1989 |
| EP | 0340504 | A2 | 11/1989 |
| EP | 1294499 | B1 | 3/2003 |
| EP | 1648625 | B1 | 9/2007 |
| JP | S59153505 | | 9/1984 |
| JP | S6068103 | | 4/1985 |
| JP | S617007 | | 1/1986 |
| JP | 1138010 | A | 5/1989 |
| WO | 0202254 | A | 1/2002 |
| WO | 2007042142 | | 4/2007 |
| WO | 2007042142 | A1 | 4/2007 |
| WO | 2007121832 | A1 | 11/2007 |

* cited by examiner

BENDING AND BALANCING DEVICE FOR AXIALLY SHIFTABLE WORK ROLLS OF A ROLLING MILL

The present application is a 371 of International application PCT/EP2010/0003848287 filed Jan. 22, 2010, which claims priority of DE 10 2009 005 964.4, filed Jan. 23, 20009, and DE 10 2009 058 876.0, filed Dec. 18, 2009, the priority of these applications is hereby claimed and these applications are incorporated herein by reference.

The invention relates to a bending and balancing device for axially displaceable work rolls of a roll stand, particularly a four-high roll stand, wherein, on both sides in the window of each row housing, guide blocks are provided in the vertical range of the work roll chocks and transmit the force of any bending and balancing cylinders to the work roll chocks which are guided in the axial direction and are guided displaceably in the vertical direction.

Roll stands of this type may be present in hot and cold rolling mills, Steckel rolling mills and plate rolling mills.

Bending and balancing devices of the above type are known, for example, EP 0 256 408 A2.

The previous stroke of the bending/balancing cylinders is limited in order to ensure sufficient guidance of the work roll chocks in the case of large work roll gaps.

SUMMARY OF THE INVENTION

It is the object of the new invention to make available a bending and balancing device which ensures a significantly greater work roll gap while simultaneously providing a constant maximum guidance of the work roll chocks.

In accordance with the invention, this object is met by a bending and balancing device for axially displaceable work rolls of a roll stand, particularly a four-high roll stand, wherein on both sides in the window of each roll housing guide blocks are provided on the vertical level of the work roll chocks, and the force of any bending and balancing cylinders can be transmitted to the work roll chocks which are displaceable in the axial direction and are guided vertically displaceably, characterized in that

- the guide blocks are each divided in an upper and a lower guide block, that
- the upper guide blocks are mounted vertically displaceably in the window of the roll housing, that
- the lower guide blocks are stationary in the window of the roll housing or are also vertically displaceable and that
- in each of the upper and lower guide blocks that belong together a bending and balancing cylinder guided by the guide blocks is arranged, wherein the bending and balancing cylinder is in engagement with the upper and the lower work roll chock.

The force transmission from the bending and balancing cylinder to the work roll chocks is preferably effected through pressure covers which rest against the work roll chocks.

As a special development it is provided that the pressure covers enclose the work roll chock ears in a positively engaging manner, or the work roll chock projections enclose the work roll chock ears in a positively engaging manner.

Consequently, the flying negative and/or positive bending device including balancing function for stationary and axially displaceable work rolls is particularly suitable for high work roll gaps.

The core concept of the solution according to the invention is the fact that the previously one-part stationary guide block is divided into an upper moveable guide block as well as a lower stationary or moveable guide block.

Arranged in the upper or lower guide block, or connected thereto, is a bending and balancing cylinder which simultaneously acts on the upper and lower work rolls and in the process is guided in the respectively other guide block.

The displacing device for the axial displacement including the work roll locking means can be mounted on both guide blocks.

The upper moveable guide block or both moveable guide blocks are guided in the roll housing.

In addition, a negative bending of the work rolls can be effected thereby that the pressure covers enclose the work roll chock ears or the guide blocks enclose the work roll chocks in a positively engaging manner.

As a result of the invention, the high reliability of the present bending and balancing device construction is coupled with a high flexibility with respect to the enlargement of the roll gap.

Another advantage resides in that, according to the invention, a minimum number of bending and balancing cylinders is sufficient for positive and negative bending, while simultaneously acting on the lower and upper work rolls.

The invention permits a greater adjustment range of work roll bending (positive and negative), which is necessary or desirable for special process requirements, for example, the Steckel process and great rolling force variations within a strip/pass.

In the following the invention shall be explained in more detail with reference to the drawings.

DETAILED DESCRIPTION OF THE INVENTION

Figure 1:
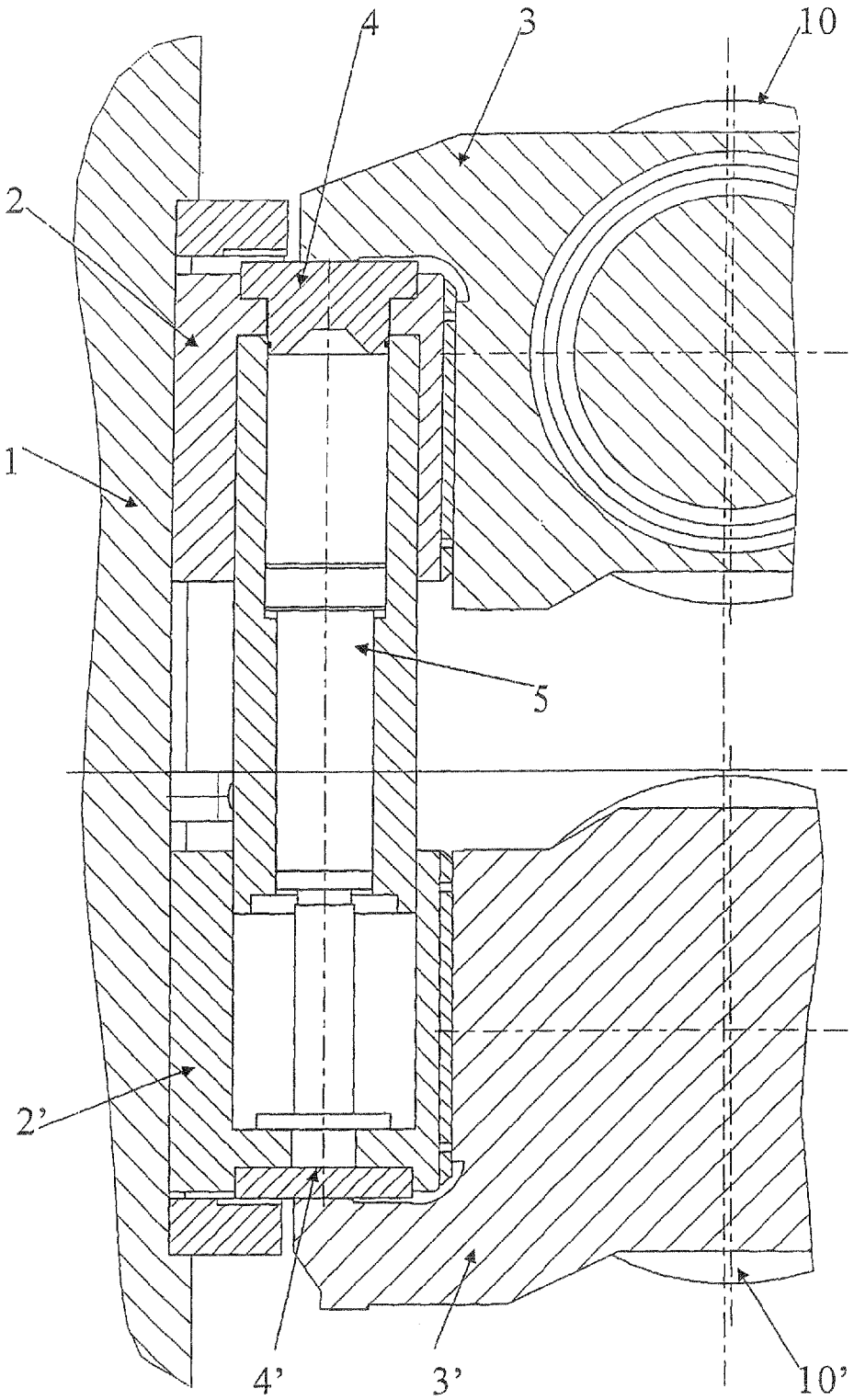
FIG. 1 shows a vertical sectional view of the bending and balancing device.
Figure 2:
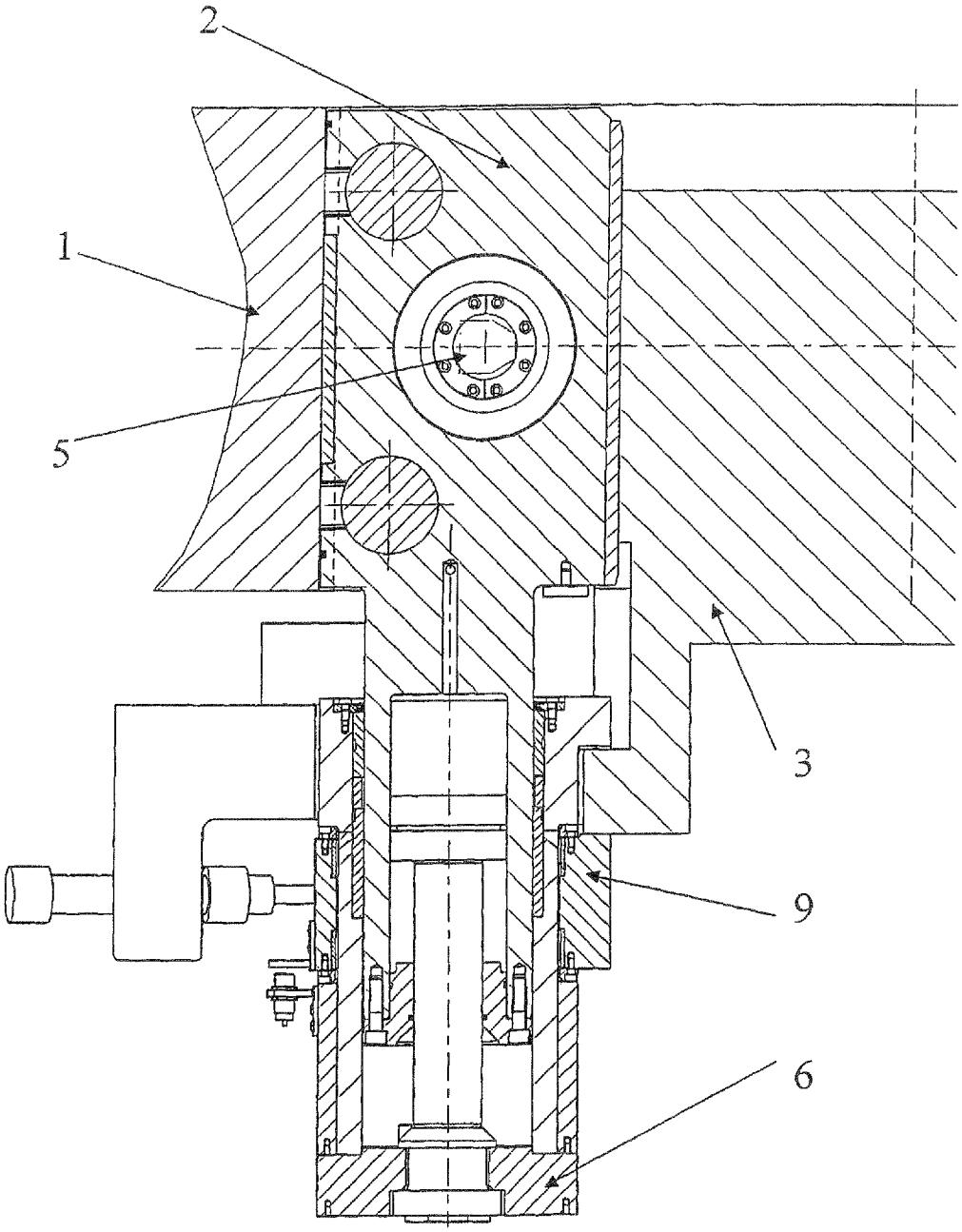
FIG. 2 shows a transverse sectional view along sectional line B-B in FIG. 1.

In the window of the roll housing 1, the work roll chocks 3 and 3' are indicated for the upper and lower work rolls 10 or 10'. The guide block divided according to the invention is fastened to the window, wherein the upper guide block 2 is mounted so as to be moveable and the lower guide block 2' is also mounted so as to be moveable or stationary. The work roll chocks 3 and 3' are displaceable in the axial direction of the work rolls by the displacing device 6 and 6'. In the vertical direction the position change is effected by the bending and balancing cylinder 5.

The bending and balancing cylinder 5 is through pressure covers 4 or 4' in engagement with the work roll chocks, or more precisely, with the ears thereof, wherein, for the invention it is also significant that through only one bending and balancing cylinder 5 the connection to the upper work roll chock 3 and the lower work roll chock 3' can be effected simultaneously.

Figure 3:
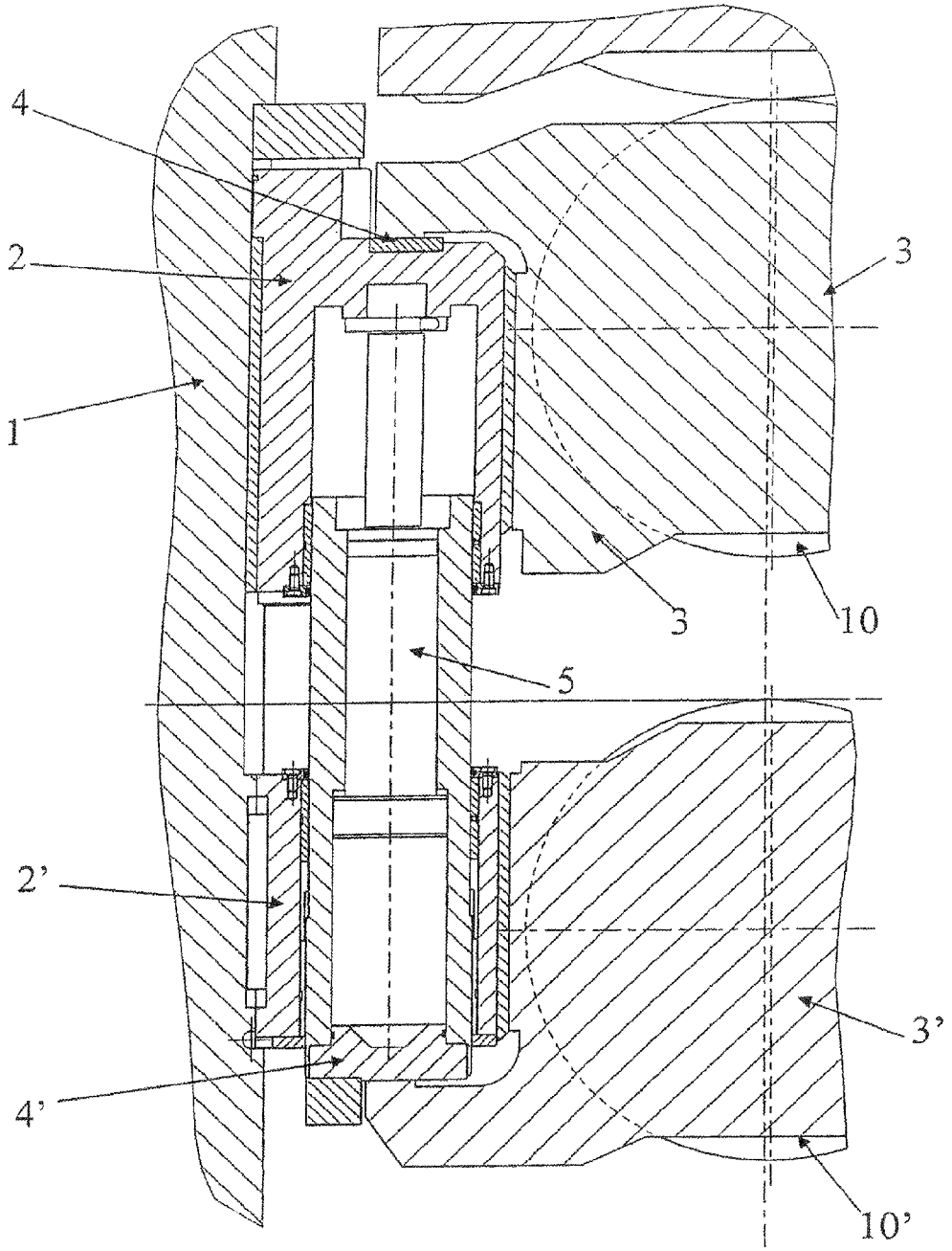
FIG. 3 shows a vertical sectional view similar to FIG. 1 showing a modified embodiment.

Through the embodiment according to FIG. 3—in deviating from the embodiment according to FIG. 1, only the piston arrangement is exchanged.

Figure 4:
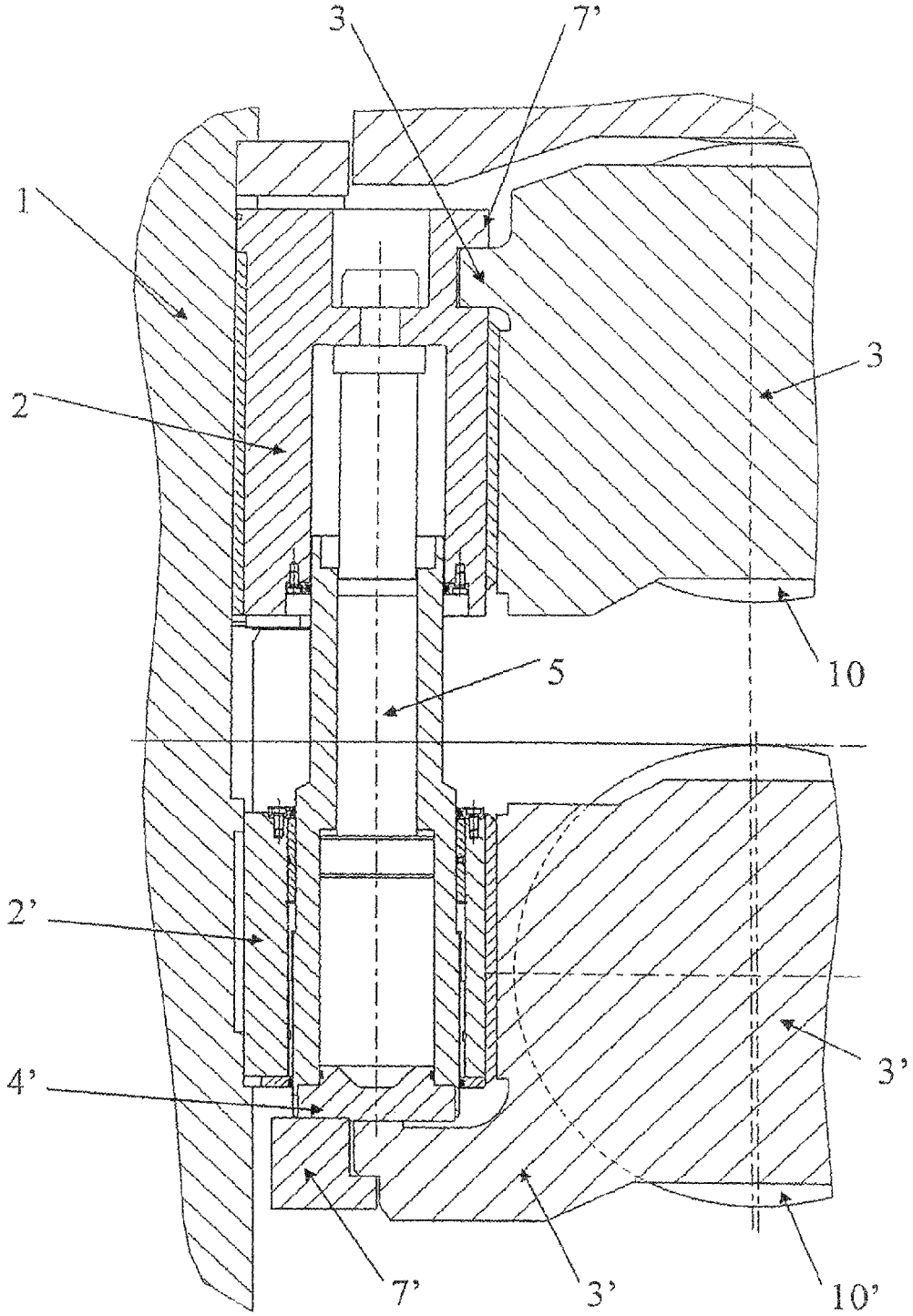
FIG. 4 shows a further embodiment.

A negative or positive adjustment of the work roll chock is achieved with the embodiment illustrated in FIG. 4.

In this case, the guide block 2 encloses the projection of the chocks 3, or the pressure cover projections 7 enclose the ears of the work roll chocks 3 or 3', so that the movement of the bending and balancing cylinder can be transmitted directly in both directions.

The invention claimed is:

1. A bending and balancing device for axially displaceable work rolls of a roll stand, comprising: guide blocks arranged on both sides of a window of each roll housing on a vertical level of upper and lower work roll chocks, and a force of bending and balancing cylinders is transmittable to the work roll chocks which are displaceably guided in an axial direction of the work rolls and so as to be vertically displaceable, wherein the guide blocks are each divided into an upper guide block and a lower guide block, the upper guide blocks being vertically displaceably mounted in the window of the roll housing, the lower guide blocks being mounted in the window of the roll housing so as to be stationary or vertically displaceable; and at least one of the bending and balancing cylinders is guided and arranged in a pair of the upper and lower guide blocks, the bending and balancing cylinder being in engagement with the upper and lower work roll chocks.

2. The bending and balancing device according to claim 1, further comprising displacing devices arranged at the upper and the lower guide blocks for axial displacement of the work roll chocks including locking means of the work rolls.

3. The bending and balancing device according to claim 1, wherein force transmission from the bending and balancing cylinders to the work roll chocks takes place through pressure covers resting against the work roll chocks.

4. The bending and balancing device according to claim 1, wherein force transmission from the bending and balancing cylinders to the work roll chocks takes place through the guide blocks.

5. The bending and balancing device according to claim 3, wherein the pressure covers or extensions of the pressure covers enclose work roll chock ears in a positively engaging manner or the guide blocks enclose projections of the work roll chocks in a positively engaging manner.

6. The bending and balancing device according to claim 1, wherein the roll stand is a four-high stand.

* * * * *